US005303829A

United States Patent [19]

Kennedy

[11] Patent Number: 5,303,829

[45] Date of Patent: Apr. 19, 1994

[54] BILLED CAP DISPLAY BRACKET

[76] Inventor: Susan B. Kennedy, 1007 Buckingham, Grosse Pointe Park, Mich. 48230

[21] Appl. No.: 52,082

[22] Filed: Apr. 22, 1993

[51] Int. Cl.[5] ..... A47F 7/00

[52] U.S. Cl. ..... 211/30; 211/32; 211/33; 248/346

[58] Field of Search ..... 211/30, 32, 33, 87; 248/346, 174

[56] References Cited

U.S. PATENT DOCUMENTS

| | | | |
|---|---|---|---|
| 1,004,605 | 10/1911 | Vanderveld . | |
| 1,255,120 | 1/1918 | Wetor . | |
| 2,876,942 | 3/1959 | Johnson | 248/346 X |
| 2,963,166 | 12/1960 | Miller | 211/32 |
| 3,726,412 | 4/1973 | Resnicoff | 211/135 |
| 3,766,864 | 10/1973 | Baker et al. | 108/111 |
| 4,238,101 | 12/1980 | Kaye | 248/346 X |
| 4,583,646 | 4/1986 | Bowman | 211/32 |
| 4,757,905 | 7/1988 | Green | 211/31 |
| 5,082,121 | 1/1992 | Grubb | 211/33 |
| 5,121,842 | 6/1992 | Osborne | 211/33 |

*Primary Examiner*—Robert W. Gibson, Jr.
*Attorney, Agent, or Firm*—Brooks & Kushman

[57] ABSTRACT

A cap support having a mounting member which can be affixed to a generally vertical mounting surface, such as a wall, and at least one cap support member which extends outwardly from spaced apart locations on the mounting member towards a common apex spaced from the mounting surface. The cap support further has a securing feature which secures the cap to the support. The cap support can also be configured to retain and position multiple caps in a side-by-side series.

34 Claims, 2 Drawing Sheets

BILLED CAP DISPLAY BRACKET

TECHNICAL FIELD

This invention relates to support racks and more particularly a support rack for display of caps and hats.

BACKGROUND ART

It is common today for people to collect billed caps, such as baseball caps and other similar novelty caps, as a hobby. Upon collecting such caps, the desire arises to display these caps in an orderly and attractive fashion. Additionally, retail stores and the like who cater to collectors and others will also desire the ability to display the different hats that they sell in an attractive fashion which will clearly display any emblem or lettering printed on the hats. Accordingly, a need has arisen for a way to support caps in an orderly and attractive fashion which is still relatively inexpensive.

One problem which arises when these types of hats are merely laid on a shelf or put on a basic display rack is that they are easily knocked off of the shelf or display by passers by. Therefore, there is also a need to have some type of a simple mechanism by which the hats can be secured to the support, to avoid having them easily fall off, and yet still be easily placed on and removed from the support. Further, the support should provide a simple and inexpensive way to accomplish these requirements, by being simple to set up, assemble and mount to wherever the hats will be displayed. Another problem with merely storing the caps on a shelf is that some of the caps may end up being stored in a crushed shape. Caps stored in this shape may not retain their original proper shape.

Consequently, the need for a new and improved wall mountable hat rack for caps which is easy to use as well as inexpensive and also securely supports the caps while maintaining their proper shape is needed for collectors as well as retailers and others.

DISCLOSURE OF INVENTION

In all its embodiments, the present invention contemplates a surface mountable cap support for a cap. The support comprises a bracket made with a mounting member for mounting the cap support onto a surface and at least one cap support member extending outwardly from spaced apart positions on the mounting member toward a common apex spaced from the surface. The cap support preferably includes a retaining means, preferably on the cap support member, for retaining and positioning the cap on the cap support. Also, preferably, the top edge of each of two spaced apart support members receive at least a portion of the cap's crown edge and the crown edge is preferably folded in upon itself and secured in retaining engagement with the retaining means.

The retaining means may consist of a retaining slot or notch within at least one of the support members. The retaining means preferably also includes a securing slot, spaced from the retaining slot or notch, which forms a securing tab engaging the cap's crown edge to thereby secure the cap.

Accordingly, it is an object of this invention to provide a hat rack for caps which will display caps in an orderly and aesthetically pleasing fashion while maintaining its proper shape and yet is simple to use and inexpensive.

It is further an object of this invention to provide the hat rack which has a means for retaining and positioning a cap on the rack while still allowing for ease of removal and placing the cap on the rack.

Advantages provided by this invention, among others, are its ease of assembly and installation, to any vertical support surface, to hold a single or multiple caps in various arrangements, as well as its inexpensive construction, which would be attractive to both individual hat collectors and retail outlets.

The foregoing and other objects, features and advantages of the present invention are readily apparent from the following detailed description of the best modes for carrying out the invention when taken in connection with the accompanying drawings.

BEST MODES FOR CARRYING OUT THE INVENTION

Figure 1:
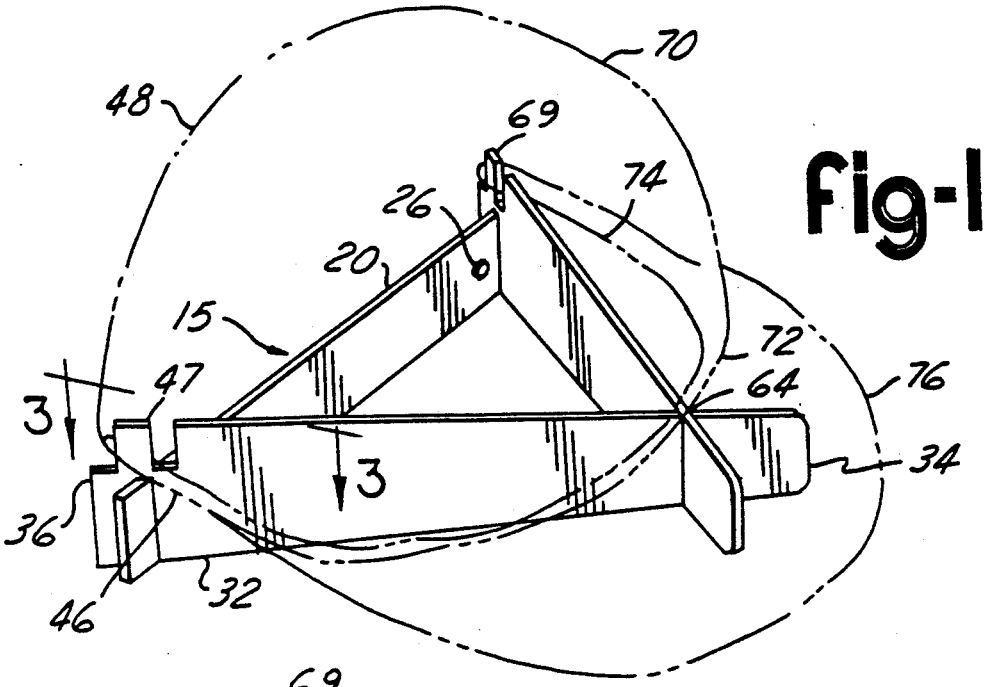
FIG. 1 is a perspective view of a cap bracket with a cap mounted thereon in accordance with the present invention.
Figure 2:
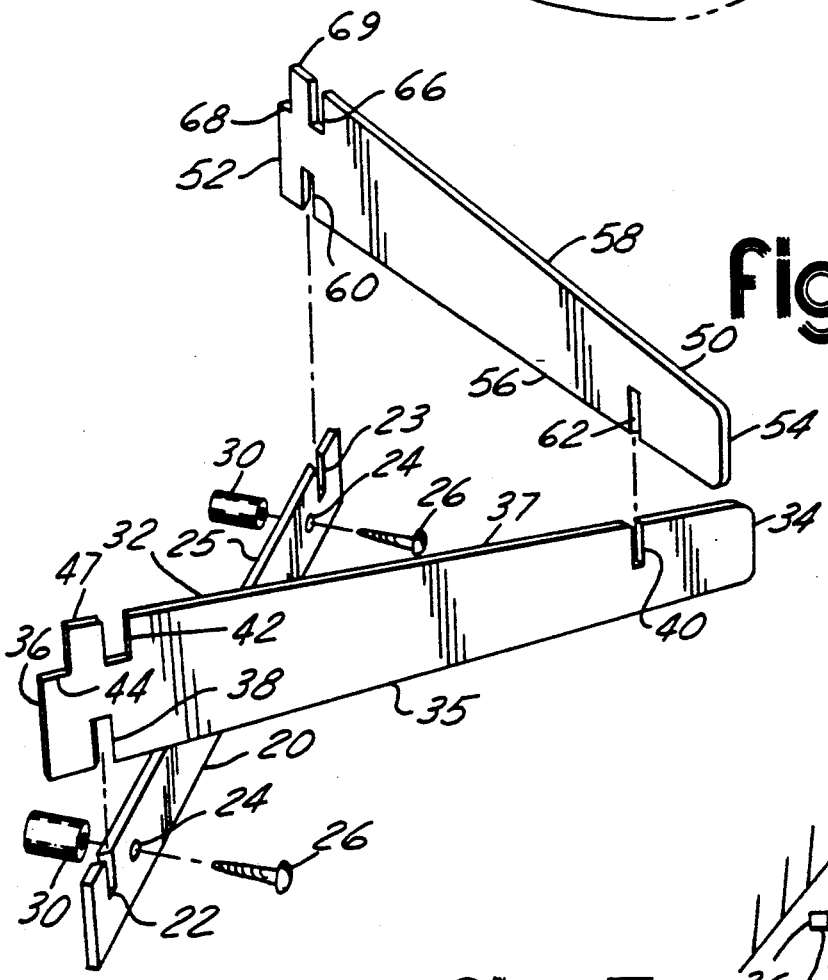
FIG. 2 is an exploded perspective view of the cap bracket in accordance with the present invention.
Figure 3:
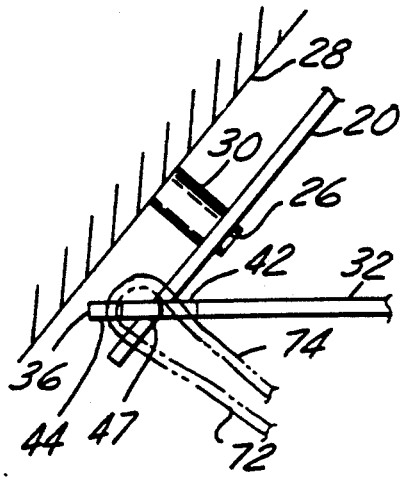
FIG. 3 is a enlarged sectional view taken along line 3—3 of FIG. 1.

FIGS. 1 to 3 illustrate the first embodiment of this invention. The rack 15 includes a mounting member 20 which has a flat, rectangular shape. The mounting member 20 and the other members discussed below preferably have rounded corners although square corners, tapered corners and other shapes are also within the scope of the invention depending upon what is desired. The members of this rack 15 are preferably made of an inexpensive plastic such as "PLEXIGLASS" although other inexpensive, lightweight materials such as a heavy duty cardboard or thin sheet metal may also be used. The mounting member 20 has two mounting slots 22, 23 each spaced apart from one of the ends of the mounting member 20 and each other. The slots 22, 23 are open on the top 25 of the mounting member 20 and are oriented at an angle so that they slant toward a common apex 64 at a point spaced apart from the wall surface.

The mounting member also has two holes 24 which extend through it for securing the bracket to a surface such as a wall 28. Optionally, the mounting member 20 may also be affixed to a pegboard or slat wall, which are mounting surfaces commonly used by retailers. In fact, the slat wall can be used as the mount upon which cap support members, discussed below, are mounted rather than using the separate mounting member 20.

Each of the mounting holes 24 receive a mounting screw 26. Aligned with and between the mounting holes 24 and the wall 28, or other generally vertical support surface, are two cylindrically shaped spacers 30. The mounting screws 26 slip through the mounting holes 24 and spacers 30 and are screwed into the wall 28, or other vertical support surface, to secure the mounting member 20 to the wall 28. The spacers 30 are preferably fabricated integral with the mounting member 20 although they can be separate pieces and accomplish the same result, which is to space the mounting member 20 sufficiently from the wall 28 to avoid interference between the wall 28 and the assembled rack 15.

A first cap support member 32 has a flat generally quadrilateral shape which is tapered on the top 37 to slope down from its back end 36 to its front end 34. The slope allows a cap 48 to rest on the rack in a level orientation when affixed to a generally vertical support surface, which is more aesthetically appealing and allows an emblem on the cap 48 to be seen by someone viewing it. The first support member 32 has a mounting attachment slot 38 near its back end 36 which opens towards the bottom 35 of the member 32. The slot 38 is oriented at an angle such that when it is inserted into the mounting slot 22 of the mounting member 20, the angle between the first support member 32 and mounting member 20 will be an acute angle slanting towards the common apex 64. Preferably, the width of the mounting slot 22 is only slightly greater than the thickness of the first support member, and the width of the mounting attachment slot 38 is only slightly greater than the thickness of the mounting member 20 such that when the slots receive one another in a sliding fit, the two members 20, 32 fit securely together. The first support member 32 also has a support member slot 40 near its front end 34 which opens to the top 37 of the member 32.

Further, opening on the top 37 of the first support member 32 located at the back 36 is retaining notch 44 spaced to be able to receive a bottom edge portion or the crown edge 46 of a cap 48. Also, preferably, located near and spaced from the retaining notch 44 is a securing slot 42. This spacing forms a securing tab 47 between the retaining notch 44 and securing slot 42.

A second cap support member 50 also has a flat tapered quadrilateral shape similar to the first support member 32. The cap support members 32, 50 do not necessarily have to be tapered from front to back, although the tapered shape is preferred for the most appealing way to mount the hat 48. The second cap support member 50 also has a mounting attachment slot 60 near its back end 52 which opens towards the bottom 56 of the second support member 50. The slot 60 is oriented at an angle such that when it is inserted into the mounting slot 23 of the mounting member 20, the second support member 32 will angle inward towards the common apex 64 thereby completing the generally triangular shape of the rack 15. The mounting attachment slot 60 slips into the mounting slot 23 in the same fashion as with the first support member 32.

The second support member 50 also has a support member slot 62 near its front end 54 which opens to the bottom 56. The first and second support members 32, 50 angle towards each other such that both of their support member slots 40, 62 align with one another when the two support members are assembled with the mounting member 20. Both of the slots 40, 62, then, are oriented at an angle to receive one another in slip fit with the width of each slot just sufficient to receive the width of the other support member 32, 50. Thus, they fit within and secure to one another forming a common apex 64 at their intersection spaced from the mounting member 20. Although in the preferred embodiment, the two support members 32, 50 intersect and extend past the common apex, the two support members can also be shorter such that they do not extend far enough to intersect one another. This will still support a cap adequately so long as the support members extend under a front portion 72 of the cap's crown edge 46 or brim 76.

Opening to the top 58 located at the back end 52 is a retaining notch 68 able to receive the crown edge 46 of the cap 48. Again, located near and spaced from the retaining notch 68 is a securing slot 66, forming a securing tab 69 between the two. Although the cap 48 can be secured to the rack 15 by using only the securing slot 42 and notch 44 on the first cap support member 32, it is preferred that both support members have the securing slots and retaining notches to better retain the cap 48.

Once assembled and hung on the wall 28, or other support surface, the rack 15 is ready to support the cap 48. Two different methods exist for positioning and retaining the cap 48 on this type of rack depending upon the relative sizes of the cap and rack and how a person would wish to secure the cap. The first way is to place the cap 48 on the rack 15 such that the crown edge 46 wraps around the securing tabs 47, 69 with a back portion 74 of the cap 48 stretching relatively straight between the two tabs 47, 69 and a front semi-circular portion 72 and cap brim 76 resting upon the top 37, 58 of the support members 32, 50. The cap 48 is now properly positioned and retained by the rack 15. The cap 48 can be removed by lifting it straight up off of the rack 15.

In the second way to hang the cap 48 on the rack 15, the crown 70 is folded back upon itself. The front semi-circular portion 72 then has the back portion 74 nested within it. When the hat 48 is placed upon the rack 15, the crown edge 46 is nested in the rack 15 such that a portion of the crown edge 46 forming the front portion 72 wraps around each of the securing tabs 47, 69 through the retaining notches 44, 68, and also a portion of the crown edge 46 forming the back portion 74 winds through each of the securing slots 42, 66. A portion of the remainder of bottom rim 46 and the hat brim 76, then, rest upon the tops 37, 58 of the first and second cap support members 32, 50. The cap 48 is now firmly secured to the rack 15 and will not fall off. To remove the cap 48 from the rack 15, the cap 48 only needs to be lifted straight up to slip the bottom rim 46 out of the securing slots 42, 66 and notches 44, 68. Both of these methods for supporting the cap 48, consequently, provide a three point support for the cap 48; two spaced support points with retaining means near the mount and a third support point spaced from the mount.

This first embodiment can be modified to support a series of hats by extending the mounting member 20 to double, triple or other multiples of its basic length and repeating the pattern of slots 22, 23 at the same spaced intervals to mate with multiple pairs of the cap support members 32, 50. The mounting holes 24 could be left between each of the pairs of slots as in the single hat configuration or changed so that a hole is placed between each hat support to secure the overall rack 15 to a wall. Also, the first embodiment could be modified such that the cap support members 32, 50 have a slight curvature to them along their lengths, rather than being flat, for aesthetic appeal.

Figure 4:
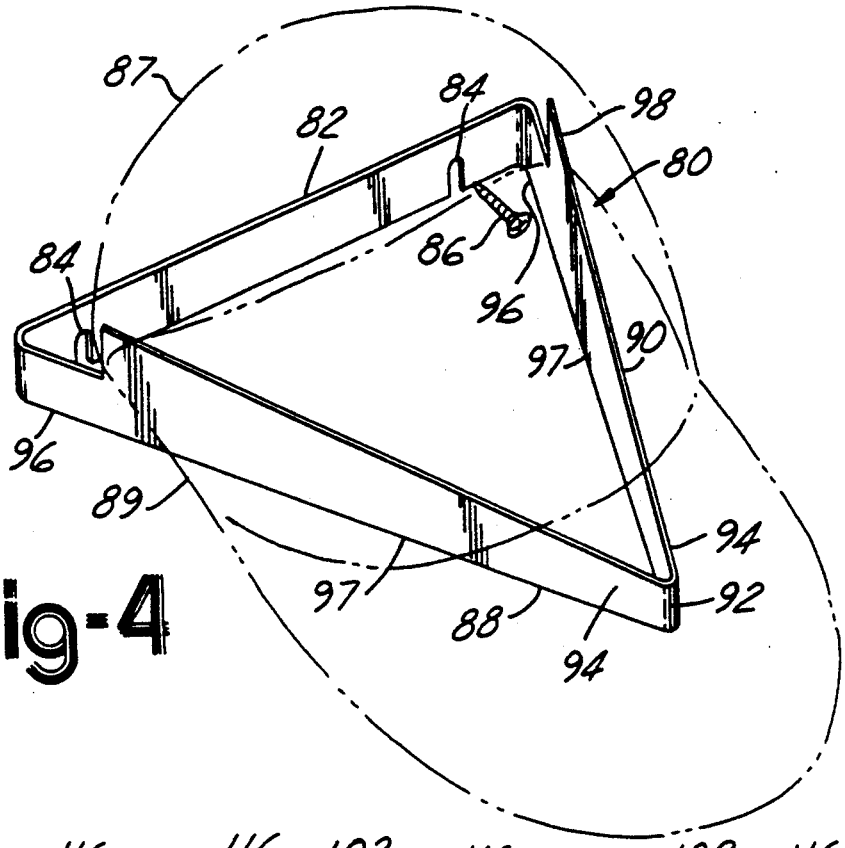
FIG. 4 is a perspective view of a first alternative embodiment of the cap bracket with a cap mounted thereon in accordance with the present invention.

A second embodiment is illustrated in FIG. 4. In this embodiment, the overall rack 80 is made of a single piece of material which forms the overall triangular shape. A mounting portion 82 basically has a flat rectangular shape with a plurality of spaced mounting slots 84. In the instant case it is shown with two mounting slots 84. The mounting slots 84 are adapted to receive, in sliding fit, screws 86 or pegs which are partially screwed into a wall or other surface to mount the rack 80. Instead of mounting slots 84 and screws 86, the rack 80 can also be affixed to a wall or support member using glue, double stick tape or other similar adhesive materials.

The first and second support portions 88, 90 project out from opposite ends of the mounting portion 82 and meet at a common apex 92 spaced from the mounting portion 82. Again, both of the support portions 88, 90 are tapered such that the tops 95 slope down from the back ends 96 to the front ends 94. Located at the back end 96 and on the top 95 of each of the support portions 88, 90 is a narrow cut out portion forming a retaining notch 98.

A cap 87 will mount on this rack 80 in a similar manner to the way it mounts on the first embodiment of the rack. The cap 87 will wrap around the securing notch 98 to secure it in place. The cap 87 can be positioned and retained on the rack 80 either with the crown edge 89 folded in upon itself or not.

This embodiment of the rack 80 may also be configured with the retaining notch and securing slot configuration of the first embodiment to better secure the cap 87, as well as the first embodiment employing this notched retaining configuration to mount a cap to it.

Figure 5:
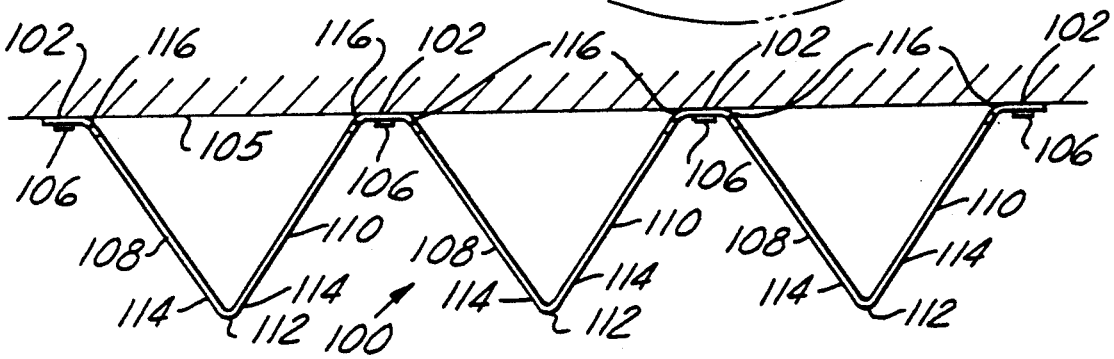
FIG. 5 is a plan view of a second alternative embodiment of the cap bracket in accordance with the present invention.
Figure 6:
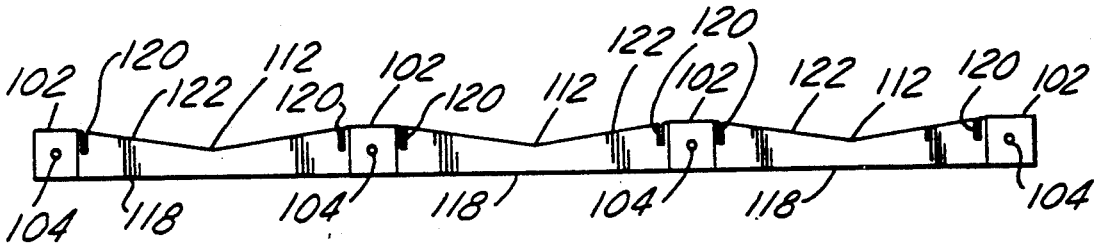
FIG. 6 is a front elevation view of the embodiment illustrated in FIG. 5.

FIGS. 5 and 6 illustrate a third embodiment of this invention. In this embodiment, the overall rack 100 is preferably made of a single piece of material forming a series of triangular shapes. The preferable material is inexpensive plastic. This will hold a plurality of caps. In this particular illustration, three cap supports are shown. There are four mounting portions 102 and each is basically a flat rectangular shape having a single mounting hole 104, although more mounting holes can be provided if so desired. The mounting holes 104 are adapted to receive screws 106 which screw into a wall 105, or other surface, to mount the rack 100. Instead of using mounting holes 104 with screws 106, the rack 100 can again also be affixed to a wall 105 or mounting surface using glue, double stick tape or other similar adhesive materials.

Three pairs of first and second support portions 108, 110 each project out from the mounting portion 102. Each pair meets at its common apex 112, spaced from each other apex 112 and the mounting portions 102. Preferably, the intersection of the support portions 108, 110 and the mounting portion 102 as well as the intersection of the pairs of support portions 108, 110 at each common apex are molded to form living hinges. The living hinge is made by a molding process whereby the material at the hinge is flexible enough to bend without breaking. For example, the thickness of the material at the intersections could be varied or the material could be corrugated at this point. This allows the overall structure to be flexible at these intersections, so that the overall structure is collapsible to reduce its size for packaging and shipping. Living hinges can also be used in the second embodiment.

The support portions 108, 110 of each pair are tapered such that the tops 122 slope down from the back ends 116 to the front ends 114. At the back end 116 of each of the support portions 108, 110 is a retaining slot 120 which opens on the top 122 near the back end 116 spaced to be able to receive a crown edge of a cap.

A billed cap will mount on this rack 100 in a similar manner to the way it mounts on the first two embodiments of the rack. A bottom rim will slip through the securing slot 120 to secure it in place. A crown of a hat can again be folded in upon itself if so desired.

This embodiment of the rack 100 may also be configured with the retaining notch and securing slot configuration of the first embodiment as well as the first embodiment employing this slotted retaining configuration to secure a hat to it. Further, it could be configured using the retaining notch of the second embodiment if the mounting portions 102 were configured having a narrower width. Furthermore, this embodiment of the rack 100 can be configured to also have a securing slot, spaced from the retaining slot 120, which would form a tab between them which functions the same as the securing slot and tab in the first embodiment when mounting a cap on the rack 100.

Moreover, this embodiment of the rack 100 may be configured to hold only one hat at a time by eliminating all but one pair of support portions 108, 110 and one pair of mounting holes 104, one on either side of the support portions 108, 110. Additionally, spacers may optionally be used in the second and third embodiment in a similar manner to the way that spacers 30 are used in the first embodiment, although they need not be.

Although particular embodiments of the present invention have been illustrated in the accompanying drawings and described in the foregoing detailed description, it is to be understood that the present invention is not to be limited to just the embodiments disclosed. For example, the cap support members could angle downward relative to the mounting member rather than tapering the cap support members; or the bracket could be configured to mount to surfaces which are angled from vertical while still maintaining the cap in a level position. Therefore, numerous rearrangements, modifications and substitutions are possible without departing from the scope of the claims hereafter.

I claim:

1. A surface mountable cap support for a cap having a crown edge portion comprising:

a mount for mounting the cap support onto the surface;

at least one cap support member extending outwardly from spaced apart positions on the mount narrowing toward a common apex adapted to be spaced from the surface; and retaining means on the at least one cap support member for retaining and positioning the cap on the cap support member by receiving at least a portion of the crown edge.

2. The cap support of claim 1 wherein the mount comprises a mounting member having a flat shape and means for affixing the mounting member to the surface.

3. The cap support of claim 1 wherein the at least one cap support comprises at least two flat plates, each having interlocking means at one end thereof and coupled respectively at the other end thereof to the mount at the spaced apart positions.

4. The cap support of claim 3 wherein each of the flat plates tapers from their respective spaced apart positions toward the common apex whereby the taper of the flat plates will allow the cap to be received on the cap support in a level position.

5. The cap support of claim 4 wherein the flat plates interlock with each other at the common apex.

6. The cap support of claim 1 wherein the retaining means will retain and position the cap on the at least one cap support member when the crown edge is folded in upon itself.

7. The cap support of claim 1 wherein the at least one cap support member tapers from its spaced apart positions toward the common apex.

8. The cap support of claim 1 wherein the mount comprises a mounting member including at least one hole adapted to receive a like number of fasteners whereby the fasteners secure the mounting member to the surface.

9. The cap support of claim 1 wherein the retaining means includes a retaining notch in the top edge of the at least one cap support member whereby the retaining notch is engageable by the crown edge and will retain the cap.

10. The cap support of claim 9 further comprising a securing slot spaced from the retaining notch forming a securing tab therebetween and engageable by the crown edge when folded in upon itself, whereby the cap will be secured to the cap support when the crown edge is wrapped around the securing tab and engaged in the retaining notch and the securing slot of the retaining means.

11. The cap support of claim 1 wherein the retaining means includes a retaining slot in the top of each of the at least one cap support members adjacent to the mounting means, and engageable by the crown edge, whereby the cap will be retained by the cap support when the crown edge engages the retaining slot.

12. The cap support of claim 11 wherein the retaining means further includes a securing slot within each of the at least one cap support members adjacent to the mounting means and spaced from the retaining slot to form a securing tab therebetween, and engageable by the crown edge, whereby the cap will be secured to the cap support when the crown edge is wrapped around the securing tab and engages the retaining slot and securing slot.

13. The cap support of claim 1 wherein the mount comprises a mounting member having a flat shape and means for securing the mounting member to the surface, and wherein the at least one cap support member comprises a pair of cap support members which are formed integrally with the mounting member whereby the shape of the cap support is triangular.

14. The cap support of claim 13 wherein the pair of cap support members taper from their respective spaced apart positions toward the common apex to thereby be adapted to receive the cap in a level position.

15. The cap support of claim 1 wherein the at least one cap support member extends to and intersects at the common apex.

16. The cap support of claim 1 wherein the at least one cap support member is comprised of more than one cap support member and the mount comprises a plurality of mounting members which are integral with the more than one cap support members whereby a plurality of caps can be supported.

17. A surface mountable cap support for a cap having a crown edge comprising:

a mounting member;

fastening means for affixing the mounting member to the surface; and at least one pair of cap support members slidingly received within the mounting member which extend outwardly from spaced apart positions on the mounting member toward a common apex spaced from the mounting member, each of the cap support members including a top edge configuration for retaining and positioning the crown edge.

18. The cap support of claim 17 wherein each of the top edge configurations comprises a retaining notch adjacent to the mounting member and a securing slot spaced from the retaining notch forming a securing tab therebetween, whereby the securing slots and retaining notches will secure the cap to the cap support by receiving the crown edge into the retaining notch and securing slot when the crown edge is wrapped around the securing tab.

19. The cap support of claim 17 wherein the mounting member includes at least one hole therethrough and the fastening means includes a like number of fasteners and spacers associated with the at least one spaced hole, the at least one spaced hole adapted to receive the corresponding like number of fasteners whereby the fasteners secure the mounting member to the surface.

20. A surface mountable cap support for a plurality of caps each having a crown edge portion and a brim comprising:

a plurality of mounting portions;

a plurality of pairs of cap support portions adjacent to one another in side-by-side relation, each mounting portion coupled to and located adjacent a pair of cap support portions;

fastening means for affixing the plurality of mounting portions to the surface; and securing means on at least one cap support portion of each pair of the cap support portions for retaining and positioning the plurality of caps to the associated cap support members by receiving at least a portion of each cap's respective crown edge.

21. The cap support of claim 20 wherein the securing means includes a securing slot within each of the cap support portions adjacent to the respective mounting portions, and engageable by the respective crown edge of the caps, whereby the caps will be secured to their respective cap supports when the crown edges engage the securing slots.

22. The cap support of claim 20 wherein the plurality of pairs of cap support portions are adapted to have a sufficient length to support underneath the brim of the cap when the crown edge of the cap is folded in upon itself.

23. A surface mountable cap support for a cap having a crown edge portion comprising:

a mount for mounting the cap support onto the surface;

at least one cap support member extending outwardly from spaced apart positions on the mount toward a common apex adapted to be spaced from the surface;

retaining means on the at least one cap support member for retaining and positioning the cap on the cap support member by receiving at least a portion of the crown edge; and wherein the at least one cap support member tapers from its spaced apart positions toward the common apex.

24. A surface mountable cap support for a cap having a crown edge portion comprising:

a mount for mounting the cap support onto the surface;

at least one cap support member extending outwardly from spaced apart positions on the mount toward a common apex adapted to be spaced from the surface;

retaining means on the at least one cap support member for retaining and positioning the cap on the cap support member by receiving at least a portion of the crown edge; and wherein the mount comprises a mounting member including at least one hole adapted to receive a like number of fasteners whereby the fasteners secure the mounting member to the surface.

25. A surface mountable cap support for a cap having a crown edge portion comprising:

a mount for mounting the cap support onto the surface;

at least one cap support member extending outwardly from spaced apart positions on the mount toward a common apex adapted to be spaced from the surface;

retaining means on the at least one cap support member for retaining and positioning the cap on the cap support member by receiving at least a portion of the crown edge; and wherein the retaining means includes a retaining notch in the top edge of the at least one cap support member, whereby the retaining notch is engageable by the crown edge and will retain the cap.

26. The cap support of claim 25 further comprising a securing slot spaced from the retaining notch forming a securing tab therebetween and engageable by the crown edge when folded in upon itself, whereby the cap will be secured to the cap support when the crown edge is wrapped around the securing tab and engaged in the retaining notch and the securing slot of the retaining means.

27. A surface mountable cap support for a cap having a crown edge portion comprising:

a mount for mounting the cap support onto the surface;

at least one cap support member extending outwardly from spaced apart positions on the mount toward a common apex adapted to be spaced from the surface;

retaining means on the at least one cap support member for retaining and positioning the cap on the cap support member by receiving at least a portion of the crown edge; and wherein the retaining means includes a retaining slot in the top of each of the at least one cap support members adjacent to the mounting means, and engageable by the crown edge, whereby the cap will be retained by the cap support when the crown edge engages the retaining slot.

28. The cap support of claim 27 wherein the retaining means further includes a securing slot within each of the at least one cap support members adjacent to the mounting means and spaced from the retaining slot to form a securing tab therebetween, and engageable by the crown edge, whereby the cap will be secured to the cap support when the crown edge is wrapped around the securing tab and engages the retaining slot and securing slot.

29. A surface mountable cap support for a cap having a crown edge portion comprising:

a mount for mounting the cap support onto the surface;

at least one cap support member extending outwardly from spaced apart positions on the mount toward a common apex adapted to be spaced from the surface;

retaining means on the at least one cap support member for retaining and positioning the cap on the cap support member by receiving at least a portion of the crown edge; and wherein the mount comprises a mounting member having a flat shape and means for securing the mounting member to the surface, and wherein the at least one cap support member comprises a pair of cap support portions which are formed integrally with the mounting member whereby the shape of the cap support is triangular.

30. The cap support of claim 29 wherein the pair of cap support portions taper as they extend from their respective spaced apart positions toward the common apex.

31. A surface mountable cap support for a cap having a crown edge portion comprising:

a mount for mounting the cap support onto the surface;

at least one cap support member extending outwardly from spaced apart positions on the mount toward a common apex adapted to be spaced from the surface;

retaining means on the at least one cap support member for retaining and positioning the cap on the cap support member by receiving at least a portion of the crown edge; and wherein the at least one cap support member extends to and intersects at the common apex.

32. A surface mountable cap support for a cap having a crown edge portion comprising:

a mount for mounting the cap support onto the surface;

at least one cap support member extending outwardly from spaced apart positions on the mount toward a common apex adapted to be spaced from the surface;

retaining means on the at least one cap support member for retaining and positioning the cap on the cap support member by receiving at least a portion of the crown edge; and wherein the at least one cap support member is comprised of more than one cap support member and the mount comprises a plurality of mounting members which are integral with the more than one cap support members whereby a plurality of caps can be supported.

33. The cap support as defined in claim 32 wherein said more than one cap support member are formed in one piece.

34. The cap support as defined in claim 1 wherein said mount and said at least one cap support member are formed in one piece.

* * * * *